US009523057B2

(12) United States Patent
Wager et al.

(10) Patent No.: US 9,523,057 B2
(45) **Date of Patent: *Dec. 20, 2016**

(54) FUEL ADDITIVES TO MAINTAIN OPTIMUM INJECTOR PERFORMANCE

(75) Inventors: James Wager, Richmond, VA (US); David P. Cleaver, Chesterfield, VA (US); Matthew H. Lindner, Richmond, VA (US); Julienne M. Galante-Fox, Midlothian, VA (US); Scott D. Schwab, Richmond, VA (US); John Bennett, Coggeshall (GB)

(73) Assignee: Afton Chemical Corporation, Richmond, VA (US)

( * ) Notice: Subject to any disclaimer, the term of this patent is extended or adjusted under 35 U.S.C. 154(b) by 353 days.

This patent is subject to a terminal disclaimer.

(21) Appl. No.: 13/031,972

(22) Filed: Feb. 22, 2011

(65) Prior Publication Data

US 2012/0210966 A1 Aug. 23, 2012

(51) Int. Cl.
*C10L 1/232* (2006.01)
*C10L 10/04* (2006.01)
(Continued)

(52) U.S. Cl.
CPC ..... *C10L 10/04* (2013.01); *C10L 1/143* (2013.01); *C10L 10/00* (2013.01); *C10L 10/08* (2013.01); *C10L 1/1616* (2013.01); *C10L 1/1824* (2013.01); *C10L 1/1881* (2013.01); *C10L 1/1888* (2013.01); *C10L 1/221* (2013.01); *C10L 1/224* (2013.01); *C10L 1/232* (2013.01); *C10L 1/2383* (2013.01); *C10L 2200/0446* (2013.01);
(Continued)

(58) Field of Classification Search
USPC ..... 44/343, 385, 411
See application file for complete search history.

(56) References Cited

U.S. PATENT DOCUMENTS 3,172,892 A 3/1965 Le Suer et al.
3,202,678 A 8/1965 Stuart et al.
(Continued)

*Primary Examiner* — Ellen McAvoy
(74) *Attorney, Agent, or Firm* — Luedeka Neely Group, P.C.

(57) ABSTRACT

A diesel fuel additive package, diesel fuel containing the additive and methods for operating an engine on the diesel fuel and additive. The fuel additive includes a reaction product of (a) a hydrocarbyl substituted dicarboxylic acid or anhydride, and (b) an amine compound or salt thereof of the formula wherein R is selected from hydrogen and a hydrocarbyl group containing from about 1 to about 15 carbon atoms, and $R^1$ is selected from hydrogen and a hydrocarbyl group containing from about 1 to about 20 carbon atoms. The reaction product contains at least one amino triazole group. Component (2) of the additive is a hydrocarbyl succinimide dispersant. The additive also includes (3) a $C_2$ to $C_{10}$ alkyl alcohol; and (4) optionally, a lubricity additive. In the additive, a weight ratio of component (1) to component (2) in the fuel ranges from about 1:3 to about 1:5.

22 Claims, 5 Drawing Sheets

(51) Int. Cl.

| | |
|---|---|
| ***C10L 1/14*** | (2006.01) |
| ***C10L 10/00*** | (2006.01) |
| ***C10L 10/08*** | (2006.01) |
| *C10L 1/16* | (2006.01) |
| *C10L 1/182* | (2006.01) |
| *C10L 1/188* | (2006.01) |
| *C10L 1/224* | (2006.01) |
| *C10L 1/2383* | (2006.01) |
| *C10L 1/22* | (2006.01) |

(52) U.S. Cl.
CPC ..... *C10L 2230/20* (2013.01); *C10L 2230/22* (2013.01); *C10L 2270/026* (2013.01)

(56) References Cited

U.S. PATENT DOCUMENTS

| | | | | |
|---|---|---|---|---|
| 3,216,936 | A | | 11/1965 | Le Suer |
| 3,219,666 | A | | 11/1965 | Norman et al. |
| 3,254,025 | A | | 5/1966 | Le Suer |
| 3,272,746 | A | | 9/1966 | Le Suer et al. |
| 3,361,673 | A | | 1/1968 | Stuart et al. |
| 3,676,089 | A | | 7/1972 | Morris et al. |
| 4,152,499 | A | | 5/1979 | Boerzel et al. |
| 4,231,759 | A | | 11/1980 | Udelhofen et al. |
| 4,234,435 | A | | 11/1980 | Meinhardt et al. |
| 4,482,357 | A | | 11/1984 | Hanlon |
| 4,605,808 | A | | 8/1986 | Samson |
| 5,080,815 | A | * | 1/1992 | Fenoglio et al. ..... 508/190 |
| 5,385,588 | A | * | 1/1995 | Brennan et al. ..... 44/331 |
| 5,393,309 | A | | 2/1995 | Cherpeck |
| 5,496,480 | A | * | 3/1996 | Rollin et al. ..... 508/293 |
| 5,514,190 | A | | 5/1996 | Cunningham et al. |
| 5,575,823 | A | | 11/1996 | Wallace et al. |
| 5,620,486 | A | | 4/1997 | Cherpeck |
| 5,634,951 | A | | 6/1997 | Colucci et al. |
| 5,697,988 | A | | 12/1997 | Malfer et al. |
| 5,725,612 | A | | 3/1998 | Malfer et al. |
| 5,876,468 | A | | 3/1999 | Moreton |
| 6,129,772 | A | * | 10/2000 | Weers et al. ..... 44/385 |
| 7,597,725 | B2 | * | 10/2009 | Caprotti et al. ..... 44/385 |
| 7,867,295 | B2 | * | 1/2011 | Schield et al. ..... 44/385 |
| 8,287,608 | B2 | * | 10/2012 | Schwab ..... 44/412 |
| 8,425,627 | B2 | * | 4/2013 | Dietz et al. ..... 44/385 |
| 2008/0216394 | A1 | | 9/2008 | Schwab |
| 2009/0249683 | A1 | | 10/2009 | Schwab |
| 2009/0282731 | A1 | * | 11/2009 | Malfer et al. ..... 44/387 |
| 2010/0037514 | A1 | * | 2/2010 | Malfer et al. ..... 44/343 |
| 2010/0107479 | A1 | * | 5/2010 | Richardson ..... 44/343 |
| 2010/0107482 | A1 | * | 5/2010 | Bennett et al. ..... 44/403 |
| 2010/0317552 | A1 | | 12/2010 | Griffin et al. |
| 2011/0283603 | A1 | * | 11/2011 | Mabille et al. ..... 44/343 |

* cited by examiner

FUEL ADDITIVES TO MAINTAIN OPTIMUM INJECTOR PERFORMANCE

TECHNICAL FIELD

The disclosure is directed to certain diesel fuel additives and to diesel fuels and diesel fuel additive packages that include the additive. In particular the disclosure is directed a diesel fuel additive that is effective to enhance the performance a diesel engine with respect to fuel economy and power output.

BACKGROUND AND SUMMARY

It has long been desired to maximize fuel economy, power and driveability in diesel fuel powered vehicles while enhancing acceleration, reducing emissions, and preventing hesitation. While it is known to enhance gasoline powered engine performance by employing dispersants to keep valves and fuel injectors clean, such gasoline dispersants are not necessarily effective in diesel fuel applications. The reasons for this unpredictability lie in the many differences between how diesel engines and gasoline engines operate and the chemical differences between diesel fuel and gasoline.

Over the years, dispersant compositions for diesel fuel have been developed. Dispersant compositions known in the art for use in diesel fuel include compositions may included polyalkylene succinimides, which are the reaction products of polyalkylene succinic anhydrides and amines. Dispersants are suitable for keeping soot and sludge suspended in a fluid, however these are not particularly effective for cleaning surfaces once deposits have formed on the surfaces. Hence, diesel fuel compositions that include dispersants often still produce undesirable deposits on diesel engine injectors. Deposits on the injectors may lead to poor fuel economy and per power performance of the engines. The deposits may include coking deposits caused by the combustion of the fuel and internal deposits caused by decomposition or deposition of solids on components of fuel injectors.

Accordingly, improved compositions that can prevent deposit injector and nozzle build up, maintaining "as new" cleanliness for the vehicle life are desired. Ideally, the same composition that can clean up dirty fuel injectors restoring performance to the previous "as new" condition would be equally desirable and valuable in the attempt to reduce air borne exhaust emissions.

In accordance with the disclosure, exemplary embodiments provide a diesel fuel, diesel fuel additive package and method for improving the fuel economy of a diesel engine. The fuel additive includes, in one embodiment, a reaction product of (a) a hydrocarbyl substituted dicarboxylic acid or anhydride, and (b) an amine compound or salt thereof of the formula

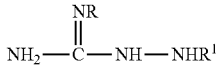

wherein R is selected from hydrogen and a hydrocarbyl group containing from about 1 to about 15 carbon atoms, and $R^1$ is selected from hydrogen and a hydrocarbyl group containing from about 1 to about 20 carbon atoms. The reaction product is made at a temperature ranging from about 155° to about 200° C. at atmospheric pressure and contains at least one amino triazole group. Component (2) of the additive package is a hydrocarbyl succinimide dispersant. The additive package also includes (3) a $C_2$ to $C_{10}$ alkyl alcohol; and (4) optionally, a lubricity additive that, when used, may be present in a weight ratio of component (2) to component (4) in the fuel ranging from about 0.5:1 to about 1.5:1. In the additive package, the hydrocarbyl group of component (1) and (2) is derived from a 500 to 1300 number average molecular weight hydrocarbyl group and a weight ratio of component (1) to component (2) in the fuel ranges from about 1:3 to about 1:5.

Another embodiment of the disclosure provides a method for improving fuel economy of a diesel engine. The method includes combusting a fuel composition containing a major amount of fuel and from 20 mg to 1000 mg per Kg of fuel of a fuel additive composition in the engine. The fuel additive composition includes: (1) a reaction product derived from (a) an amine compound or salt thereof of the formula

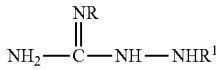

wherein R is selected from hydrogen and a hydrocarbyl group containing from about 1 to about 15 carbon atoms, and $R^1$ is selected from hydrogen and a hydrocarbyl group containing from about 1 to about 20 carbon atoms and (b) a hydrocarbyl carbonyl compound of the formula

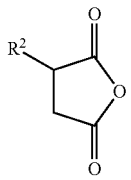

wherein $R^2$ is a hydrocarbyl group having a number average molecular weight ranging from about 500 to about 1300. The reaction product is made at a temperature ranging from about 155° to about 200° C. at atmospheric pressure and the reaction product contains at least one amino triazole group. Another component of the additive composition is (2) a hydrocarbyl succinimide dispersant derived from a hydrocarbyl group having a number average molecular weight ranging from about 500 to less than about 1300 Daltons and a succinic anhydride. The additive also includes (3) a C2 to C10 alkyl alcohol; and (4) a lubricity additive; and (5) optionally, a demulsifier. A weight ratio of component (1) to component (2) in the fuel ranges from about 1:3 to about 1:5 so that the fuel economy of the diesel engine is improved relative to the fuel economy of the same diesel engine in the absence of the fuel additive composition.

A further embodiment of the disclosure provides a method of cleaning fuel injectors of a fuel injected diesel engine. The method includes combusting a fuel composition in the engine that includes a major amount of diesel fuel and from 20 mg to 1000 mg per Kg of fuel of fuel additive composition. The fuel additive composition includes (1) a reaction product derived from (a) an amine compound or salt thereof of the formula

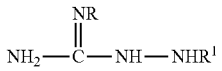

wherein R is selected from hydrogen and a hydrocarbyl group containing from about 1 to about 15 carbon atoms, and $R^1$ is selected from hydrogen and a hydrocarbyl group containing from about 1 to about 20 carbon atoms and (b) a hydrocarbyl carbonyl compound of the formula

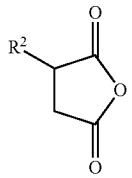

wherein $R^2$ is a hydrocarby group having a number average molecular weight ranging from about 700 to about 1000 and greater than about 60 molar % terminal double bonds. The reaction product is made at a temperature ranging from about 155° to about 200° C. at atmospheric pressure and the reaction product contains at least one amino triazole group. The additive composition also includes (2) a hydrocarbyl succinimide dispersant derived from a hydrocarbyl group having a number average molecular weight ranging from about 700 to less than about 1000 Daltons and a succinic anhydride. Other components of the additive composition include (3) a lubricity additive; and (4) a demulsifier. A weight ratio of component (1) to component (2) in the fuel ranges from about 1:3 to about 1:5. Use of the fuel and additive in the diesel engine provides injectors that are cleaner in the engine combusting the fuel containing the additive composition than injectors in an engine combusting the fuel in the absence of the additive.

An advantage of the fuel additive package described herein is that the additive package may not only reduce the amount of deposits forming on direct and/or indirect diesel fuel injectors, but the additive package may also be effective to clean up dirty fuel injectors, increase fuel economy, and provide improved power performance. The deposit reduction on internal and external injector components and the clean up effect of the additive package may be demonstrated in post 2007 model year engine technology.

Another advantage of the fuel and additives package described herein is that the additive package may provide conductivity properties to a fuel that reduce or eliminate the need for expensive high sulfur containing conductivity additives that are used at fuel terminal locations. Fuels containing the additive package described herein may also exhibit lower corrosion potential in storage and terminal locations. Additional embodiments and advantages of the disclosure will be set forth in part in the detailed description which follows, and/or can be learned by practice of the disclosure. It is to be understood that both the foregoing general description and the following detailed description are exemplary and explanatory only and are not restrictive of the disclosure, as claimed.

DETAILED DESCRIPTION OF EXEMPLARY EMBODIMENTS

Figure 1:
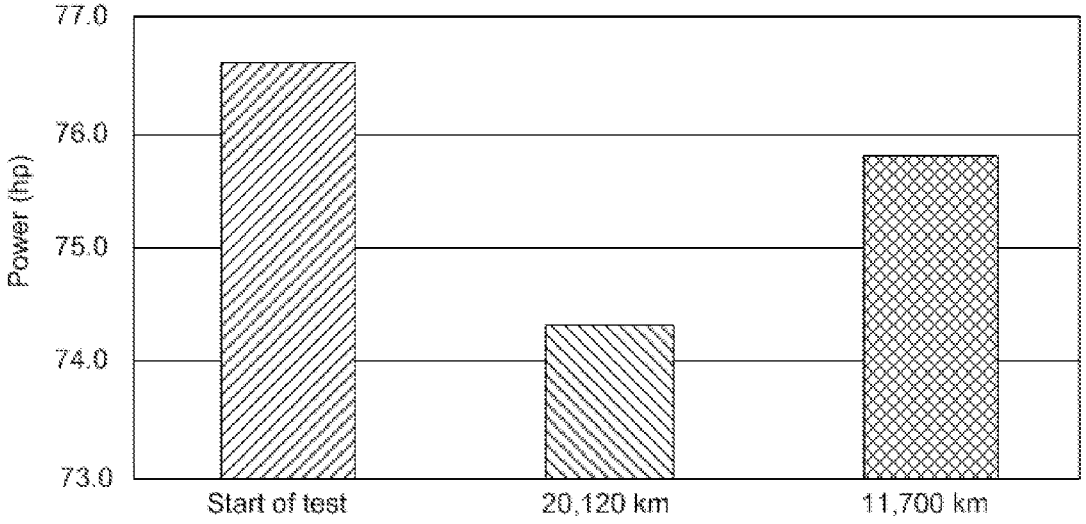
FIGS. 1 and 2 are graphical representations of power recovery for diesel engines containing fuel additives according to the disclosure at two different treat rates.

As used herein, the term "hydrocarbyl group" or "hydrocarbyl" is used in its ordinary sense, which is well-known to those skilled in the art. Specifically, it refers to a group having a carbon atom directly attached to the remainder of a Molecule and having a predominantly hydrocarbon character. Examples of hydrocarbyl groups include:

(1) hydrocarbon substituents, that is, aliphatic (e.g., alkyl or alkenyl), alicyclic (e.g., cycloalkyl, cycloalkenyl) substituents, and aromatic-, aliphatic-, and alicyclic-substituted aromatic substituents, as well as cyclic substituents wherein the ring is completed through another portion of the molecule (e.g., two substituents together form an alicyclic radical);

(2) substituted hydrocarbon substituents, that is, substituents containing non-hydrocarbon groups which, in the context of the description herein, do not alter the predominantly hydrocarbon substituent (e.g., halo (especially chloro and fluoro), hydroxy, alkoxy, mercapto, alkylmercapto, nitro, nitroso, and sulfoxy);

(3) hetero-substituents, that is, substituents which, while having a predominantly hydrocarbon character, in the context of this description, contain other than carbon in a ring or chain otherwise composed of carbon atoms. Hetero-atoms include sulfur, oxygen, nitrogen, and encompass substituents such as pyridyl, furyl, thienyl, and imidazolyl. In general, no more than two, or as a further example, no more than one, non-hydrocarbon substituent will be present for every ten carbon atoms in the hydrocarbyl group; in some embodiments, there will be no non-hydrocarbon substituent in the hydrocarbyl group.

As used herein, the term "major amount" is understood to mean an amount greater than or equal to 50 wt. %, for example from about 80 to about 98 wt. % relative to the total weight of the composition. Moreover, as used herein, the term "minor amount" is understood to mean an amount less than 50 wbt. % relative to the total weight of the composition.

For the purposes of this disclosure, all molecular weights are given in terms of number average molecular weight as determined by gel permeation chromatography (GPC).

Component (1) of the additive compositions of the present application may be used in a minor amount in a major amount of diesel fuel and may be made by reacting an amine compound or salt thereof of the formula

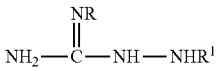

wherein R is selected from the group consisting of a hydrogen and a hydrocarbyl group containing from about 1 to about 15 carbon atoms, and $R^1$ is selected from the group consisting of hydrogen and a hydrocarbyl group containing from about 1 to about 20 carbon atoms with a hydrocarbyl carbonyl compound of the formula

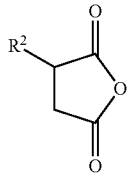

wherein $R^2$ is a hydrocarbyl group having a number average molecular weight ranging from about 200 to about 3000, for example from about 500 to about 1300 number average molecular weight. Without desiring to be bound by theoretical considerations, it is believed that the reaction product of the amine and hydrocarbyl carbonyl compound is an aminotriazole, such as a bis-aminotriazole compound of the formula

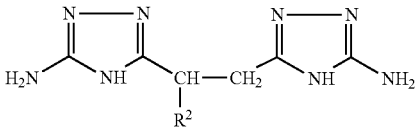

including tautomers having a number average molecular weight ranging from about 500 to about 1300 containing from about 40 to about 80 carbon atoms. In one embodiment the molecular weight of $R^2$ ranges from about 750 to about 1000 Daltons. Suitably the molecular weight of $R^2$ is less than 1000 Daltons. The five-membered ring of the triazole is considered to be aromatic. The aminotriazoles are fairly stable to oxidizing agents and are extremely resistant to hydrolysis. It is believed, although it is not certain, that the reaction product is polyalkenyl bis-3-amino-1,2,4-triazole. Such a product contains a relatively high nitrogen content, within the range of about 2 wt % to about 10 wt % nitrogen.

Suitable amine compounds of the formula

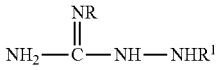

may be chosen from guanidines and aminoguanidines or salts thereof wherein R and $R^1$ are as defined above. Accordingly, the amine compound may be chosen from the inorganic salts of guanidines, such as the halide, carbonate, nitrate, phosphate, and orthophosphate salts of guanidines. The term "guanidines" refers to guanidine and guanidine derivatives, such as aminoguanidine. In one embodiment, the guanidine compound for the preparation of the additive is aminoguanidine bicarbonate. Aminoguanidine bicarbonates are readily obtainable from commercial sources, or can be prepared in a well-known manner.

The hydrocarbyl carbonyl reactant compound of component (1) of the additive may be any suitable compound having a hydrocarbyl moiety and a carbonyl moiety, and that is capable of bonding with the amine compound to form the additives of the disclosure. Non-limiting examples of suitable hydrocarbyl carbonyl compounds include, but are not limited to, hydrocarbyl substituted succinic anhydrides, hydrocarbyl substituted succinic acids, and esters of hydrocarbyl substituted succinic acids.

In some aspects, the hydrocarbyl carbonyl compound can be a polyalkylene succinic anhydride reactant having the following formula:

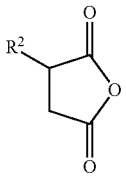

wherein $R^2$ is a hydrocarbyl moiety, such as for example, a polyalkenyl radical having a number average molecular weight of from about 500 to about 1300. For example, the number average molecular weight of $R^2$ may range from about 750 to about 1000 as measured by GPC. Unless indicated otherwise, molecular weights in the present specification are number average molecular weights.

The $R^2$ polyalkenyl radicals may comprise one or more polymer units chosen from linear or branched alkenyl units. In some aspects, the alkenyl units may have from about 2 to about 10 carbon atoms. For example, the polyalkenyl radical may comprise one or more linear or branched polymer units chosen from ethylene radicals, propylene radicals, butylene radicals, pentene radicals, hexene radicals, octene radicals and decene radicals. In some aspects, the $R^2$ polyalkenyl radical may be in the form of, for example, a homopolymer, copolymer or terpolymer. In one aspect, the polyalkenyl radical is isobutylene. For example, the polyalkenyl radical may be a homopolymer of polyisobutylene comprising from about 10 to about 60 isobutylene groups, such as from about 20 to about 30 isobutylene groups. The polyalkenyl compounds used to form the $R^2$ polyalkenyl radicals may be formed by any suitable methods, such as by conventional catalytic oligomerization of alkenes.

In an additional aspect, the hydrocarbyl moiety $R^2$ may be derived from a linear alpha olefin or an acid-isomerized alpha olefin made by the oligomerization of ethylene by methods well known in the art. These hydrocarbyl moieties can range from about 8 carbon atoms to over 40 carbon atoms. For example, alkenyl moieties of this type may be derived from a linear $C_{18}$ or a mixture of $C_{20-24}$ alpha olefins or from acid-isomerized $C_{16}$ alpha olefins.

In some aspects, high reactivity polyisobutenes having relatively high proportions of polymer molecules with a terminal vinylidene group may be used to form the $R^2$ group. In one example, at least about 60 mole %, such as about 70 mole % to about 90 mole %, of the polyisobutenes comprise terminal olefinic double bonds. High reactivity polyisobutenes are disclosed, for example, in U.S. Pat. No. 4,152,499, the disclosure of which is herein incorporated by reference in its entirety. In some embodiments, the ratio of the number of carbonyl groups to the number of hydrocarbyl moieties in the hydrocarbyl carbonyl compound may range from about 1:1 to about 6:1.

In some aspects, approximately one mole of maleic anhydride may be reacted per mole of polyalkylene, such that the resulting polyalkenyl succinic anhydride has about 0.8 to about 1 succinic anhydride group per polyalkylene substituent. In other aspects, the molar ratio of succinic anhydride groups to alkylene groups may range from about 0.5 to about 3.5, such as from about 1 to about 1.1.

The hydrocarbyl carbonyl compounds may be made using any suitable method. Methods for forming hydrocarbyl carbonyl compounds are well known in the art. One example of a known method for forming a hydrocarbyl carbonyl compound comprises blending a polyolefin and maleic anhydride. The polyolefin and maleic anhydride reactants are heated to temperatures of, for example, about 150° C. to about 250° C., optionally, with the use of a catalyst, such as chlorine or peroxide. Another exemplary method of making the polyalkylene succinic anhydrides is described in U.S. Pat. No. 4,234,435, which is incorporated herein by reference in its entirety.

The hydrocarbyl carbonyl and amine compounds described above may be mixed together and/or reacted under suitable conditions to provide the desired product containing an aminotriazole of the present disclosure. In one aspect of the present disclosure, the reactant compounds may be mixed together in a mole ratio of hydrocarbyl carbonyl to amine ranging from about 1:1 to about 1:2.5. For example, the mole ratio of the reactants may range from about 1:1.5 to about 1:2.2.

Suitable reaction temperatures may range from about 155° C. to about 200° C. at atmospheric pressure. For example, reaction temperatures may range from about 160° C. to about 190° C. Any suitable reaction pressures may be used, such as, including subatmospheric pressures or superatmospheric pressures. However, the range of temperatures may be different from those listed where the reaction is carried out at other than atmospheric pressure. The reaction may be carried out for a period of time within the range of about 1 hour to about 8 hours, preferably, within the range of about 2 hours to about 6 hours.

Component (2) of the additive composition may include a dispersant/detergent. The dispersant/detergent may be an ashless dispersant, a metal-containing dispersant, or a Mannich dispersant. A suitable dispersant/detergent may include at least one oil-soluble ashless dispersant having a basic nitrogen and/or at least one hydroxyl group in the molecule. Other suitable dispersants/detergents include alkenyl succinimides, alkenyl succinic acid esters, alkenyl succinic ester-amides, and Mannich bases. For example, suitable dispersants/detergents may include, but are not limited to ethylene diamine or dibutyl amine Mannich base dispersants. In some embodiments, a suitable dispersant may have a molecular weight of from about 500 to about 1300, for example from about 700 to about 1000 number average molecular weight as determined by GPC. Suitable Mannich base detergents may include those detergents taught in U.S. Pat. Nos. 4,231,759; 5,514,190; 5,634,951; 5,697,988; 5,725,612; and 5,876,468, the disclosures of which are incorporated herein by reference.

The nitrogen-containing derivatives of hydrocarbyl succinic acylating agents suitable for use in the present embodiments may include hydrocarbyl succinimides, succinamides, succinimide-amides and succinimide-esters. The nitrogen-containing derivatives of hydrocarbyl succinic acylating agents are typically prepared by reacting a hydrocarbyl-substituted succinic acylating agent with a polyamine.

The hydrocarbyl-substituted succinic acylating agents include the hydrocarbyl-substituted succinic acids, the hydrocarbyl-substituted succinic anhydrides, the hydrocarbyl-substituted succinic acid halides (especially the acid fluorides and acid chlorides), the esters of the hydrocarbyl-substituted succinic acids and lower alcohols (e.g., those containing up to 7 carbon atoms), that is, hydrocarbyl-substituted compounds which can function as carboxylic acylating agents, and mixtures of hydrocarbyl-substituted succinic acids and hydrocarbyl-substituted succinic anhydrides.

Hydrocarbyl-substituted succinic anhydrides may be prepared by the thermal reaction of a polyolefin and maleic anhydride, as described, for example in U.S. Pat. Nos. 3,361,673 and 3,676,089. Alternatively, the substituted succinic anhydrides can be prepared by the reaction of chlorinated polyolefins with maleic anhydride, as described, for example, in U.S. Pat. No. 3,172,892. A further discussion of hydrocarbyl-substituted succinic anhydrides can be found, for example, in U.S. Pat. Nos. 4,234,435; 5,620,486 and 5,393,309.

The mole ratio of maleic anhydride to olefin can vary widely. It may vary, for example, from 5:1 to 1:5, as another example from 3:1 to 1:3, and as an even further example the maleic anhydride is used in stoichiometric excess, e.g. 1:1.5 moles maleic anhydride per mole of olefin. The unreacted maleic anhydride can be vaporized from the resultant reaction mixture.

A suitable hydrocarbyl substituent is one derived from polyisobutene. Suitable polyisobutenes for use in preparing the succinimide-acids include those polyisobutenes that comprise at least about 20 mole % of the more reactive methylvinylidene isomer, as a further example at least 50 mole % and as an even further example at least 70 mole %. Suitable polyisobutenes include those prepared using $BF_3$ catalysts. The preparation of such polyisobutenes in which the methylvinylidene isomer comprises a high percentage of the total composition is described in U.S. Pat. Nos. 4,152,499 and 4,605,808. The polyisobutenes may have a number average molecular weight up to 2000 as determined by GPC. In another embodiment the polyisobutenes may have a molecular weight of about 500-1300 and as a further example from about 700-1000.

Hydrocarbyl succinimides are obtained by reacting a hydrocarbyl-substituted succinic anhydride, acid, acid-ester or lower alkyl ester with an amine containing at least one primary amine group. Representative examples are given in U.S. Pat. Nos. 3,172,892; 3,202,678; 3,219,666; 3,272,746; 3,254,025, 3,216,936, 4,234,435; and 5,575,823. The alkenyl succinic anhydride may be prepared readily by heating a mixture of olefin and maleic anhydride to about 180-220° C.

Amines which may be reacted with the alkenyl succinic anhydride to form the hydrocarbyl-succinimide include any that have at least one primary amine group that can react to form an imide group. A few representative examples are: methylamine, 2-ethylhexylamine, n-dodecylamine, stearylamine, N,N-dimethyl-propanediamine, N-(3-aminopropyl)morpholine, N-dodecyl propanediamine, N-aminopropyl piperazine ethanolamine, N-ethanol ethylene diamine and the like. Suitable amines include the alkylene polyamines such as propylene diamine, dipropylene triamine, di-(1,2-butylene)triamine, tetra-(1,2-propylene)pentaamine.

Further suitable amines are the ethylene polyamines which have the formula H2N(CH2CH2NH)nH wherein n is an integer from one to ten. These ethylene polyamines include ethylene diamine, diethylene triamine, triethylene tetraamine, tetraethylene pentaamine, pentaethylene hexaamine, and the like, including mixtures thereof in which case n is the average value of the mixture. These ethylene polyamines have a primary amine group at each end so can form mono-alkenylsuccinimides and bis-alkenylsuccinimides. Thus suitable hydrocarbyl succinimides may include the products of reaction of a polyethylenepolyamine, tetraethylene pentamine, with a hydrocarbon substituted carboxylic acid or anhydride made by reaction of a polyolefin, for example polyisobutene, having a molecular weight of 500 to 1300, especially 700 to 1000, with an unsaturated polycarboxylic acid or anhydride, e.g. maleic anhydride and may be represented by the formula:

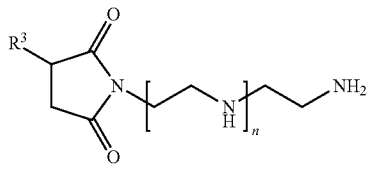

wherein n represents 0 or an integer of from 1 to 5, and $R^2$ is a hydrocarbyl substituent as defined above. In an embodiment, n is 3 and $R^3$ is a polyisobutenyl substituent, such as that derived from polyisobutylenes having at least about 60 mole %, such as about 70 mole % to about 90 mole % and above, terminal vinylidene content. Compounds of foregoing formula may be the reaction product of a hydrocarbyl-substituted succinic anhydride, such as a polyisobutenyl succinic anhydride (PIBSA), and a polyamine, for example tetraethylene pentamine (TEPA) to provide a compound of the formula:

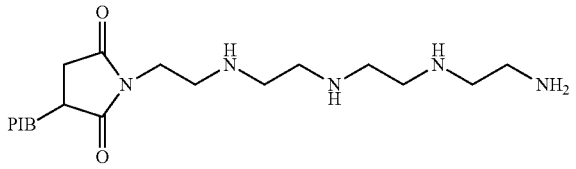

wherein PIB is polyisobutene as described above.

The $C_2$ to $C_{10}$ alkyl alcohol component of the additive composition may be selected from ethanol, propanol, isopropanol, butanol, isobutanol, tert-butyl alcohol, amyl alcohol, 2-methyl-2-butanol, tert-amyl alcohol, hexanol, heptanol, octanol, isooctyl alcohol, cyclopentanol, cyclohexanol, 2-methyl-cyclopentanonol, nonanol, decanol, and isomers thereof. A particularly useful alcohol component may 2-ethylhexanol. The amount of alcohol in the fuel additive composition may range from about 0.1 to about 5 percent by weight of the total additive composition. For example, the alcohol component of the additive composition may range from about 0.2 to about 2 percent by weight of the total weight additive composition. Other amounts of the alcohol component may range from about 0.5 to about 1.8 percent by weight of the total weight of the additive composition.

Demulsifiers (or dehazers) herein may also be used in the additive compositions described herein. The demulsifiers may be selected from any of the commercially available materials such as but not limited to alkoxylated phenol formaldehyde polymers, alkylated phenols and resins derived therefrom, oxylated alkylphenolic resin, and formaldehyde polymer with 4-(1,1-dimethylethyl)phenol, methyloxirane and oxirane, ethoxylated ethylene oxide/propylene oxide (EO/PO) resin, polyglycol ester, ethylene oxide resin, and the like. A suitable demulsifier may be a blend of four components, namely, two crosslinked EO/PO block copolymers, a modified EO/PO block copolymer and an alkoxylated alkyl phenol formaldehyde resin. The active components of such demulsifiers are typically polymers having number average molecular weight ranging from about 3,000 to about 50,000. An amount of the demulsifier component in the additive composition may range from about 0.05 to about 5 weight percent of the additive composition. Other amounts of the demulsifier may range from about 0.1 to about 3 weight percent of the total weight of the additive composition and desirably may range from about 0.5 to about 1.5 percent by weight of the total weight of the additive composition.

Yet another component of the additive composition may be a lubricity additive. The lubricity additive may be selected from an acid blend and a reaction product of a hydrocarbyl acylating agent and ammonia. Particularly preferred acid blends are carboxylic acids, such as fatty acids and mixtures thereof. Such fatty acids may be saturated or unsaturated (which includes polyunsaturated). They acids may for example contain from 1 or 2 to 30 carbon atoms, suitably from 10 to 22 carbon atoms, more particularly from 12 to 22 or from 14 to 20 carbon atoms. Examples of suitable acids include oleic acid, linoleic acid, linolenic acid, linolic acid, stearic acid, palmitic acid and myristic acid. Of these, oleic, linoleic and linolenic acids, and mixtures thereof may be particularly useful. Mixtures of fatty acids may include tall oil fatty acids, which are derived from tall oil and contains mostly fatty acids (such as oleic and linoleic) with a small proportion of rosin acids.

The reaction between the hydrocarbyl-substituted acylating agent and ammonia may also be used as a lubricity additive in addition to or as an alternative to the fatty acid lubricity additive. The hydrocarbyl group of the hydrocarbyl-substituted acylating agent may have a molecular weight that varies over a wide range. Accordingly, the hydrocarbyl group may have a number average molecular weight as determined by GPC of less than 600. An exemplary molecular weight range is from about 100 to about 300 number average molecular weight. More details of the lubricity additive described above may be found in U.S. Publication No. 2009/0249683, the disclosure of which is incorporated herein by reference.

When the lubricity additive is used, the lubricity additive may be present in the additive composition in any desired or effective amount. In one aspect, the lubricity additive may be present in the fuel and the additive composition in a weight ratio of component (2) to component (5) ranging from about 0.5:1 to about 1.5:1.

One or more additional optional components may be present in the fuel additive compositions of the disclosed embodiments. For example, the fuels may contain conventional quantities of cetane improvers, corrosion inhibitors, cold flow improvers (CFPP additive), pour point depressants, solvents, demulsifiers, lubricity additives, friction modifiers, amine stabilizers, combustion improvers, dispersants, antioxidants, heat stabilizers, conductivity improvers, metal deactivators, marker dyes, organic nitrate ignition accelerators, cyclomatic manganese tricarbonyl compounds, and the like. In some aspects, the compositions described herein may contain about 10 weight percent or less, or in other aspects, about 5 weight percent or less, based on the total weight of the additive package, of one or more of the above additives. Similarly, the fuels may contain suitable amounts of conventional fuel blending components such as methanol, ethanol, dialkyl ethers, and the like.

In some aspects of the disclosed embodiments, organic nitrate ignition accelerators that include aliphatic or cycloaliphatic nitrates in which the aliphatic or cycloaliphatic group is saturated, and that contain up to about 12 carbons may be used. Examples of organic nitrate ignition accelerators that may be used are methyl nitrate, ethyl nitrate, propyl nitrate, isopropyl nitrate, allyl nitrate, butyl nitrate, isobutyl nitrate, sec-butyl nitrate, tert-butyl nitrate, amyl nitrate, isoamyl nitrate, 2-amyl nitrate, 3-amyl nitrate, hexyl nitrate, heptyl nitrate, 2-heptyl nitrate, octyl nitrate, isooctyl nitrate, 2-ethylhexyl nitrate, nonyl nitrate, decyl nitrate, undecyl nitrate, dodecyl nitrate, cyclopentyl nitrate, cyclohexyl nitrate, methylcyclohexyl nitrate, cyclododecyl nitrate, 2-ethoxyethyl nitrate, 2-(2-ethoxyethoxy)ethyl nitrate, tetrahydrofuranyl nitrate, and the like. Mixtures of such materials may also be used.

Examples of suitable optional metal deactivators useful in the compositions of the present application are disclosed in U.S. Pat. No. 4,482,357, issued Nov. 13, 1984, the disclosure of which is herein incorporated by reference in its entirety. Such metal deactivators include, for example, salicylidene-o-aminophenol, disalicylidene ethylenediamine, disalicylidene propylenediamine, and N,N'-disalicylidene-1, 2-diaminopropane.

When formulating the fuel compositions of this application, the additives may be employed in amounts sufficient to reduce or inhibit deposit formation in a diesel engine and/or in amounts sufficient to improve the conductivity and/or corrosion resistance of the fuel. In some aspects, the fuels may contain minor amounts of the above described additive composition that is effective to control or reduce the formation of engine deposits, for example injector deposits in diesel engines. For example, the diesel fuels of this application may contain, on an active ingredient basis, an amount of the additive composition in the range of about 5 mg to about 200 mg of per Kg of fuel, such as in the range of about 20 mg to about 120 mg of additive per Kg of fuel. In aspects, where a carrier is employed, the fuel compositions can contain, on an active ingredients basis, an amount of the carrier in the range of about 1 mg to about 100 mg of carrier per Kg of fuel, such as about 5 mg to about 50 mg of dispersant per Kg of fuel. The active ingredient basis excludes the weight of (i) unreacted components remaining in the product as produced and used, (ii) solvent(s), and inactive components, if any, but before addition of a carrier, if a carrier is employed.

The additives compositions describe herein and optional components used in formulating the fuels of described herein may be blended into the base diesel fuel individually or in various sub-combinations. In some embodiments, the additive components of the disclosure may be blended into the diesel fuel concurrently using an additive package, as this takes advantage of the mutual compatibility and convenience afforded by the combination of ingredients when in the form of an additive package. Also, use of a package may reduce blending time and lessen the possibility of blending errors. The additive may be packaged and sold separately from diesel fuel in, for example, a concentrated form. The additive composition may then be blended with diesel fuel by the customer, as desired, or may be added to fuel at terminal locations where bulk fuel from a pipeline distribution system is stored. Accordingly, the additive compositions described herein may provide improvements in the corrosion properties of such fuel and/or the conductivity of the fuel. For example, the fuel additive may be effective to effectively eliminate or reduce the amount of high sulfur conductivity improver used in fuel storage terminals.

Additive packages containing the foregoing additives may generally contain the components in the amounts shown in the following table.

TABLE 1

| Component | Broad Range (wt. %) | Typical Range (wt. %) |
|---|---|---|
| Reaction product of hydrocarbyl substituted dicarboxylic acid and amine | 0.5 to 20 | 1 to 10 |
| Hydrocarbyl succinimide dispersant | 1 to 30 | 10 to 20 |
| $C_2$ to $C_{10}$ alkyl alcohol | 0.1 to 10 | 1 to 5 |
| Demulsifier | 0.01 to 5 | 0.1 to 2 |
| Lubricity additive | 0 to 40 | 0 to 25 |
| Diluents oil | Balance | Balance |
| Total | 100 | 100 |

More specific formulations used for the following examples are contained in Tables 2-4.

TABLE 2

| Base Formulation | (wt. %) |
|---|---|
| Reaction product of hydrocarbyl substituted dicarboxylic acid and amine | 3.69 |
| Hydrocarbyl succinimide dispersant | 14.47 |
| $C_2$ to $C_{10}$ alkyl alcohol | 1.4 |
| Demulsifier | 0.98 |
| Lubricity additive | 0 |
| Aromatic solvent | 79.2 |

TABLE 3

| Terminal Package 1 | (wt. %) |
|---|---|
| Reaction product of hydrocarbyl substituted dicarboxylic acid and amine | 3.34 |
| Hydrocarbyl succinimide dispersant | 13.37 |
| $C_2$ to $C_{10}$ alkyl alcohol | 1.27 |
| Demulsifier | 0.89 |
| Lubricity additive (blend of tall oil fatty acids) | 14.9 |
| Aromatic solvent | 66.22 |

TABLE 4

| Terminal Package 2 | (wt. %) |
|---|---|
| Reaction product of hydrocarbyl substituted dicarboxylic acid and amine | 3.15 |
| Hydrocarbyl succinimide dispersant | 12.58 |
| $C_2$ to $C_{10}$ alkyl alcohol | 1.2 |
| Demulsifier | 0.84 |
| Lubricity additive (alkyl succinic anhydride/ammonia reaction product) | 17.63 |
| Aromatic solvent | 64.61 |

The diesel fuels of the present application may be applicable to the operation of both stationary diesel engines (e.g., engines used in electrical power generation installations, in pumping stations, etc.) and ambulatory diesel engines (e.g., engines used as prime movers in automobiles, trucks, road-grading equipment, military vehicles, etc.). Accordingly, aspects of the present application are directed to methods for reducing the amount of injector deposits of a diesel engine having at least one combustion chamber and one or more direct fuel injectors in fluid connection with the combustion chamber. In another aspect, the improvements may also be observed in indirect diesel fuel injectors. In some aspects, the methods comprise injecting a hydrocarbon-based compression ignition fuel comprising the additive of the present application, through the injectors of the diesel engine into the combustion chamber, and igniting the compression ignition fuel. In some aspects, the method may also comprise mixing into the diesel fuel at least one of the optional additional ingredients described above.

EXAMPLES

The following examples are illustrative of exemplary embodiments of the disclosure. In these examples as well as elsewhere in this application, all parts and percentages are by weight unless otherwise indicated. It is intended that these examples are being presented for the purpose of illustration only and are not intended to limit the scope of the invention disclosed herein.

In the following examples, benefits of using the additive composition described here in diesel engine powered vehicles are provided. The following test procedure and protocol were used for the tests.

Test Procedure

According to the procedure, either vehicles were run on base fuel to accumulate mileage and deposits or high mileage vehicle(s) were procured for testing. The high mileage vehicles preferably had over 100,000 miles. The base fuel used to complete all testing was obtained from the same load/batch of fuel. No additive was present in the base fuel. The fuel economy measurements were determined in L/100 km (fuel consumption) using carbon balance calculations per 40 CFR Part 600 Subpart B. During the test, the NEDC (New European Driving Cycle) emission test results were used to show fuel economy improvement. The raw data was collected and reported for each test.

Example 1

Figure 2:
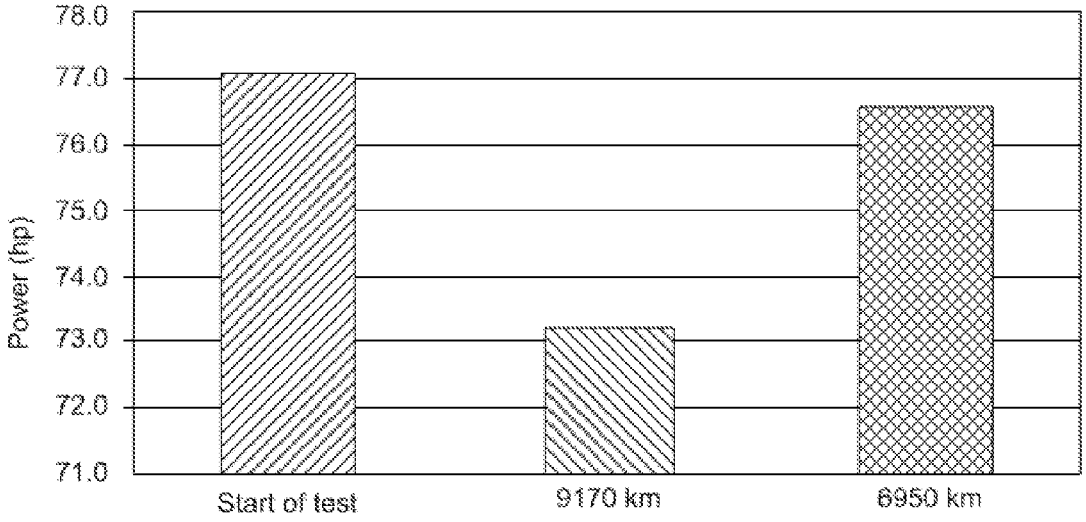

Using the foregoing procedure, tests were run using a base fuel and the base fuel additized with the additive package of Table 2 and the results are shown in FIGS. 1 and 2. In the figures, Volkswagon Jettsa combusting diesel fuel additized with 407.1 ppm by weight of the composition of Table 2 (FIG. 1) and at 814.2 ppm by weight of the composition of Table 2 (FIG. 2) was used. At the lower concentration of the additive package in the fuel, the power recovery after 7270 miles was about 67%. At the higher concentration of the additive package in the fuel, the power recovery was about 87% after 4319 miles. Accordingly, the additive package of the disclosure was effective in restoring most of the power loss exhibited by a fuel devoid of the additive package after a relatively short use of the additized fuel.

Example 2

Figure 3:
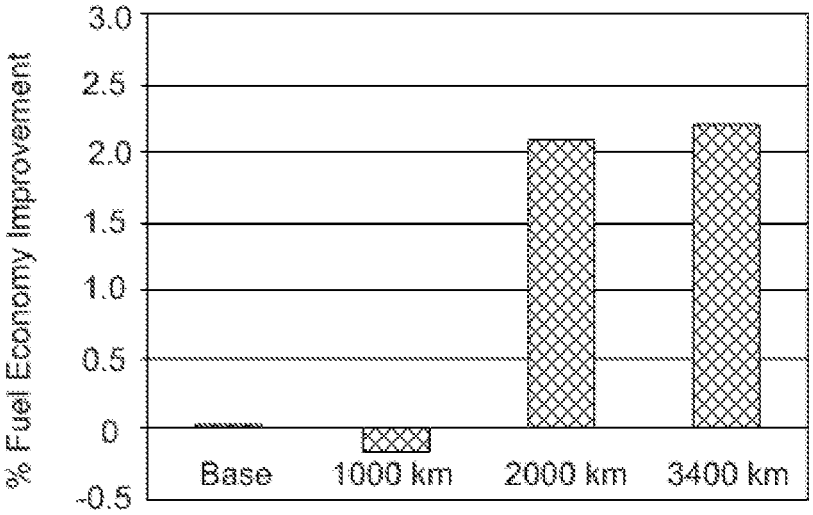
FIGS. 3 and 4 are graphical representations of fuel economy improvement for diesel engines containing fuel additives according to the disclosure at two different treat rates.
Figure 4:
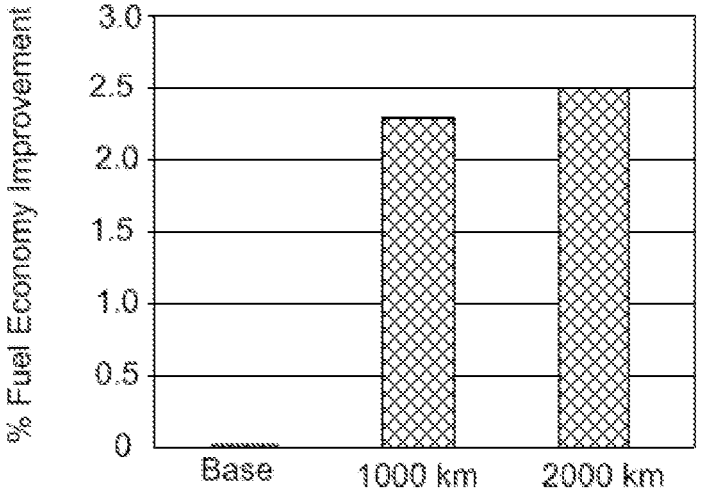

In the following tests, the ability of the additive clean up used fuel injectors for a light duty diesel engine was demonstrated. Tests were run with additized fuel using high mileage Mercedes Vito Vans to determine the fuel economy improvement that is provided by the additive package according to Table 2. In FIG. 3, the fuel containing 407.1 ppm by weight of the additive and in FIG. 4, the fuel contained 814.2 ppm by weight of the additive. The higher treat rate of additive provided quicker fuel economy improvement. Overall fuel economy improvement was 2.2 percent in FIG. 3 after 3400 km and 2.5 percent in FIG. 4 after 2000 km.

Example 3

Figure 5:
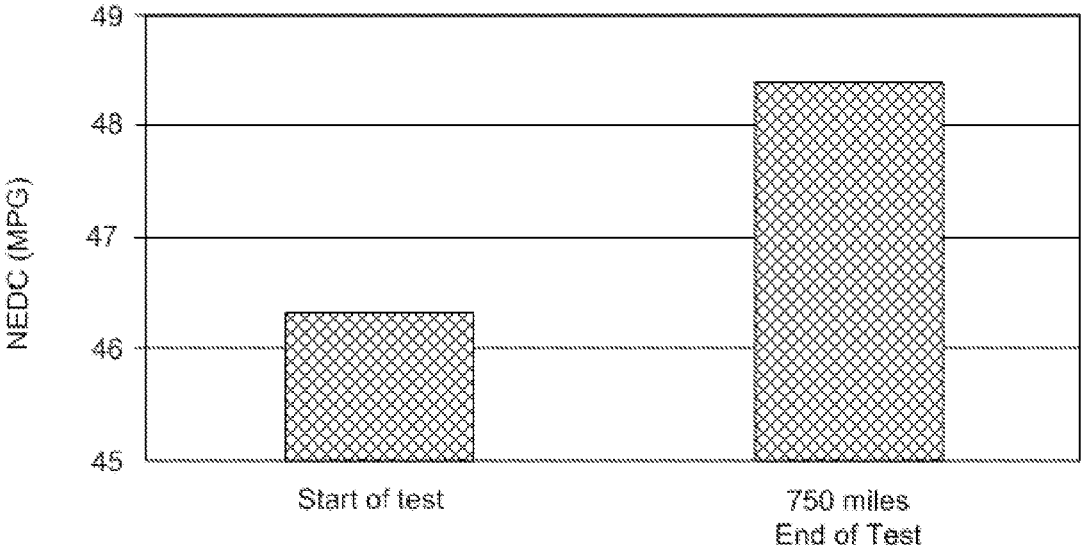
FIGS. 5 and 6 graphical representations of fuel economy after injector clean up for diesel engines containing fuel additives according to the disclosure at two different treat rates.
Figure 6:
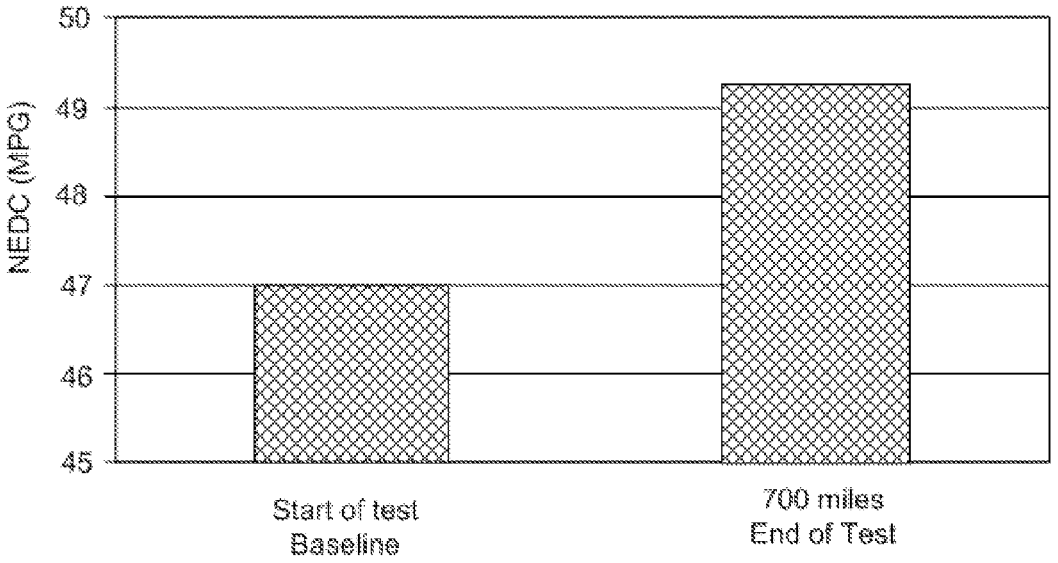

In the following tests, the ability of the additive to clean up used fuel injectors for a light duty diesel engine is demonstrated. According to the test, fuel injectors used for 75,000 km were installed in light duty diesel vehicles and the NEDC fuel economy for the vehicles was determined at the start of the test and after about 700 miles (1100 km) to 750 miles (1200 km). The results are shown in FIG. 5 for fuel containing 407.1 ppm by weight of the additive package of Table 2 and in FIG. 6 for fuel containing 814.2 ppm by weight of the additive package of Table 2. As shown in FIG. 5, at the lower treat rate there was a 4.5% improvement in fuel economy after 750 miles (1200 km) compared to the fuel economy at the start of the test. With the higher treat rate (FIG. 6), there was a 4.9% improvement in fuel economy after 700 miles (1100 km) compared to the fuel economy at the start of the test.

Example 4

In the following example the detergent properties of the additive composition were determined by use of an injector sticking engine test. The test protocol was as follows:

Test Protocol

| | |
|---|---|
| 1 | Obtain a drum (50 gallons) of base fuel |
| 2 | Install a mixing device in the drum that will run continuously during the test |
| 3 | Add the fuel contaminants to the base fuel while stirring (dodecyl succinic acid and NaOH) |
| 4 | For the keep clean tests, add the additive composition at the required treat rate. |
| 5 | To determine clean-up, run 8 the engine hours for dirty-up then 8-16 hours for clean-up with the additive composition. |
| 6 | Mix the fuel and contaminants and/or additive for two hours |
| 7 | Begin engine sticking test |
| 8 | Equip the exhaust manifold with K-type thermocouples placed 25 mm from the cylinder head exhaust ports on the engine. |
| 9 | Follow the CEC F-98 DW-10 Test procedure |
| 10 | Run the test for 8 hours, then perform a cold start to check for injector sticking |
| 11 | Monitor power loss throughout the test |
| | Cold Start Procedure after 8 hours |
| 13 | Allow the engine oil and coolant temperature to be at ambient conditions |
| 14 | Start the engine and let it idle for 5 minutes while collecting data |
| 15 | Exhaust port temperatures that deviate from those taken at the start of test indicate injectors that may be compromised by internal deposits |
| 16 | Verify stuck injectors by disassembling and analyzing the injector components under a microscope |

Figure 7:
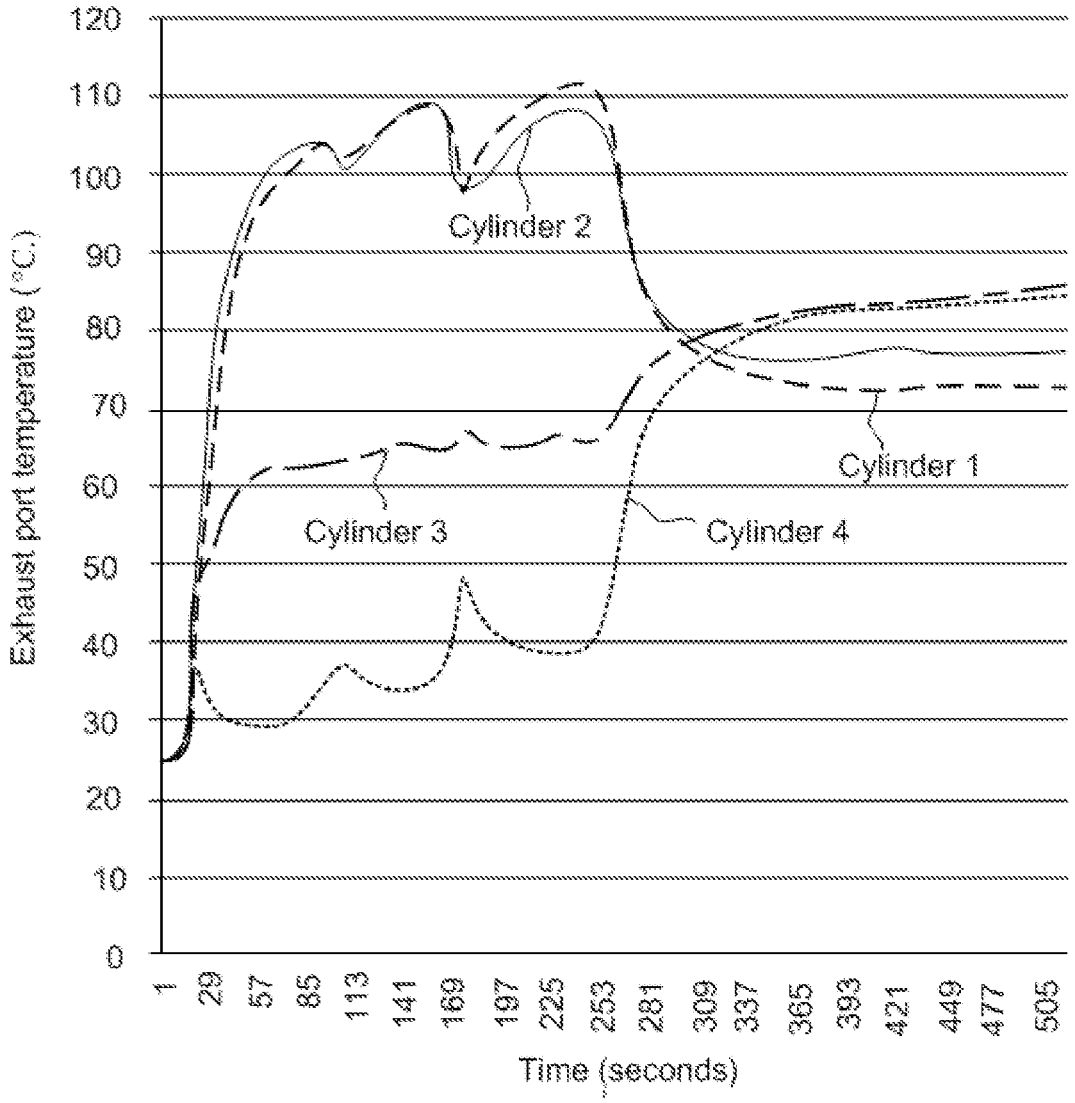
FIG. 7 is a graphical representation of exhaust gas temperatures for a four cylinder engine operating on an unadditized diesel fuel.
Figure 8:
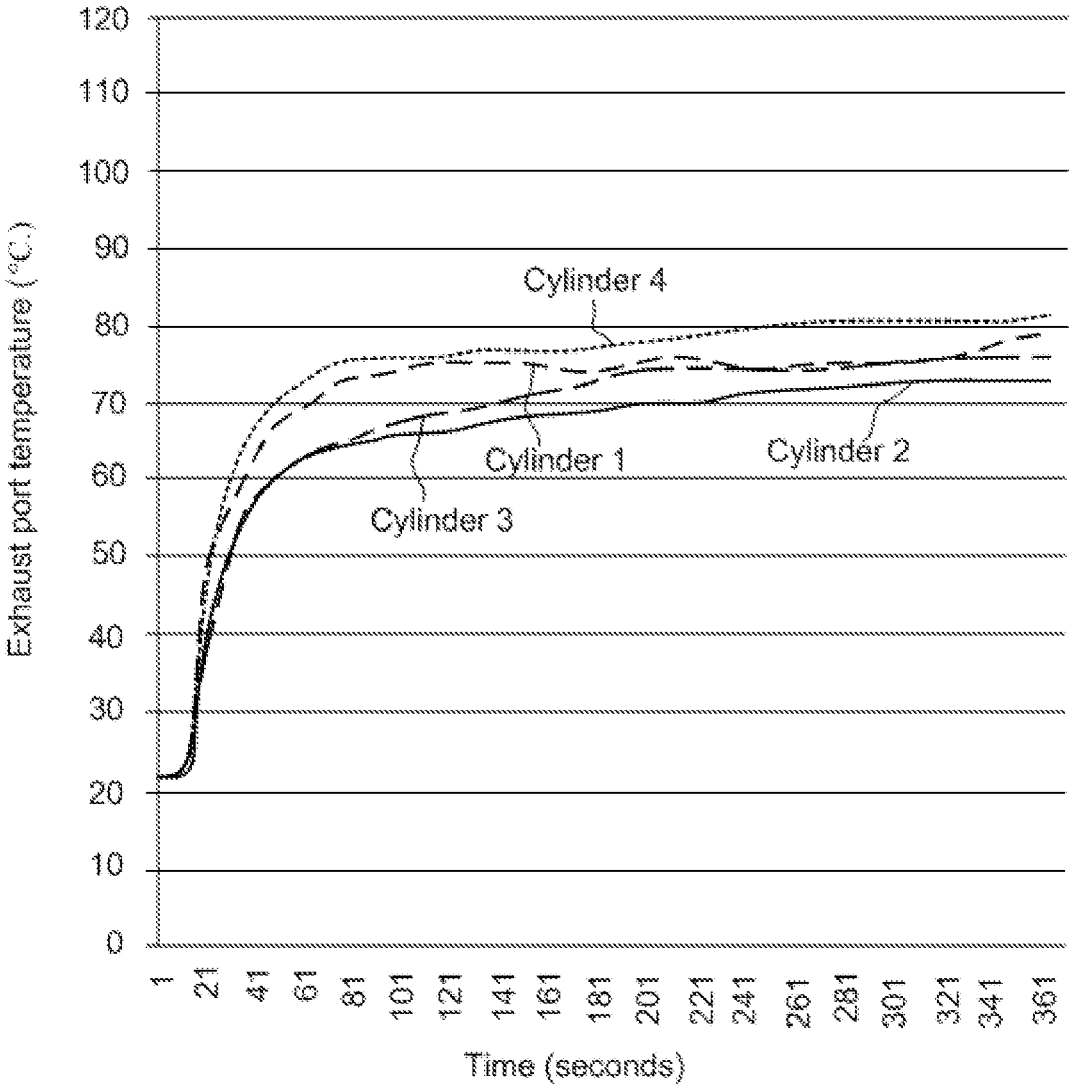
FIG. 8 is a graphical representation of exhaust gas temperatures for a four cylinder engine operating on an additized diesel fuel according to the disclosure.

FIG. 7 is an illustration of stuck injectors in the absence of the additive composition. It is believed that the stuck injectors are the results of internal deposits in the injectors. By comparison, FIG. 8 illustrates that the fuel containing 407.1 ppm by weight of the additive package of Table 2 did not exhibit any stuck injectors.

Example 5

In the following test, the conductivity of the fuel containing the additive packages according to the disclosure were included in a fuel and the conductivities of the fuels over time were determined. Table 5 contains results of the conductivity tests performed on samples of fuel containing a conventional high sulfur conductivity improver having greater than about 15 ppm sulfur and additive packages of Table 2-4. Conductivities of the test fuels were evaluated according to ASTM 2624 using an EMCEE conductivity meter (Model 1152) having a range of from about 1 to about 2000 picosiemens m−1 (pS/m). All conductivity values were measured within a temperature range of from about 0° C. to about 25° C. All conductivity measurements are in picosiemens m−1 (pS/m), also known as CU or Conductivity Units. Fuel conductivities of greater than about 25 pS/m are acceptable.

TABLE 5

| Sample Fuel # | Temp, ° C. | Conv. Cond. Improver ppm wt. | Package Table 2 ppm wt. | Package Table 3 ppm wt. | Package Table 4 ppm wt. | Conductivity pS/m 0 Hr | Conductivity pS/m 24 Hr |
|---|---|---|---|---|---|---|---|
| 1 | 21 | 0 | 0 | 0 | 0 | 0 | 0 |
| 2 | 21 | 0 | 0 | 0 | 0 | 0 | 0 |
| 3 | 21 | | 407 | | | 94 | 86 |
| 4 | 21 | | 407 | | | 76 | 82 |
| 5 | 21 | 3 | | | | 558 | 548 |
| 6 | 21 | 3 | | | | 401 | 384 |
| 7 | 21 | | | | 477 | 107 | 116 |
| 8 | 21 | | | 449 | | 63 | 55 |
| 9 | 0 | 0 | 0 | 0 | 0 | 0 | 0 |
| 10 | 0 | 0 | 0 | 0 | 0 | 0 | 0 |
| 11 | 0 | | 407 | | | 90 | 99 |
| 12 | 0 | | 407 | | | 78 | 75 |
| 13 | 0 | 3 | | | | 456 | 449 |
| 14 | 0 | 3 | | | | 311 | 305 |
| 15 | 0 | | | | 477 | 116 | 101 |
| 16 | 0 | | | 449 | | 70 | 60 |

It was observed that Sample Fuel Nos. 1, 2, 9, and 10 (comprising none of the additive packages or conductivity improver) demonstrated poor conductivity (0 pS/m). Sample Fuels 3, 4, 11 and 12 containing the additive package of Table 2 at 407 ppm by weight in the fuel provided conductivities ranging from 75 to 99 pS/m in the fuels tested even in the absence of the conventional high sulfur conductivity improver. Likewise, Sample Fuels 8 and 16 containing the additive package of Table 3 and Sample Fuels 7 and 15 containing the additive package of Table 4 also exhibited conductivities of greater than 25 pS/m even in the absence of a high sulfur conductivity improver. Accordingly, the formulations of the disclosed embodiments may provide an added benefit of reducing or eliminating the need to add a high sulfur conductivity improver in order to achieve a fuel conductivity of greater than 25 pS/m.

Example 6

In the following examples, the corrosion potential of fuels with and without the additive packages according to the disclosure were tested. The fuels used for the tests were a silica gel-stripped ultra low sulfur diesel fuel from Citgo (Fuel A), a Conoco Phillips diesel fuel from the Wood River terminal (Fuel B), and a Conoco Phillips diesel fuel from the Los Angeles terminal (Fuel C). The corrosion tests results are given in the following table.

TABLE 6

| Spindle | Additives | Fuel | Treat Rate, ppm wt. | Rating |
|---|---|---|---|---|
| 1 | None | A | n/a | E |
| | None | B | n/a | E |
| | None | C | n/a | E |
| 2 | Table 2 | A | 271 | B |
| 3 | Table 2 | B | 271 | C |
| 4 | Table 2 | C | 271 | C |
| 5 | Table 2 | A | 407 | B+ |
| 6 | Table 2 | B | 407 | B+ |
| 7 | Table 2 | C | 407 | B+ |
| 8 | Table 2 | A | 814 | A |
| 9 | Table 2 | B | 814 | A |
| 10 | Table 2 | C | 814 | A |

As shown by the foregoing examples, the fuel in the absence of the additive package exhibited a poor rating of E (Spindle 1). Fuels containing less than about 400 ppm by weight of the additive package of Table 2 also exhibited poor ratings (Spindles 2-4). However at treat rates above about 400 ppm by weight, Fuels containing the additive package of Table 2 exhibited passing rating of B+ or greater.

It is noted that, as used in this specification and the appended claims, the singular forms "a," "an," and "the," include plural referents unless expressly and unequivocally limited to one referent. Thus, for example, reference to "an antioxidant" includes two or more different antioxidants. As used herein, the term "include" and its grammatical variants are intended to be non-limiting, such that recitation of items in a list is not to the exclusion of other like items that can be substituted or added to the listed items.

For the purposes of this specification and appended claims, unless otherwise indicated, all numbers expressing quantities, percentages or proportions, and other numerical values used in the specification and claims, are to be understood as being modified in all instances by the term "about." Accordingly, unless indicated to the contrary, the numerical parameters set forth in the following specification and attached claims are approximations that can vary depending upon the desired properties sought to be obtained by the present disclosure. At the very least, and not as an attempt to limit the application of the doctrine of equivalents to the scope of the claims, each numerical parameter should at least be construed in light of the number of reported significant digits and by applying ordinary rounding techniques.

While particular embodiments have been described, alternatives, modifications, variations, improvements, and substantial equivalents that are or can be presently unforeseen can arise to applicants or others skilled in the art. Accordingly, the appended claims as filed and as they can be amended are intended to embrace all such alternatives, modifications variations, improvements, and substantial equivalents.

What is claimed is:

1. A diesel fuel composition comprising:

a major amount of middle distillate fuel; and from about 400 to about 1000 mg per Kg of fuel of a fuel additive comprising:

(1) a reaction product of (a) a hydrocarbyl substituted dicarboxylic acid or anhydride, and (b) an amine compound or salt thereof of the formula

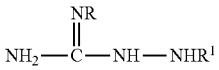

wherein R is selected from the group consisting of hydrogen and a hydrocarbyl group containing from about 1 to about 15 carbon atoms, and $R^1$ is selected from the group consisting of hydrogen and a hydrocarbyl group containing from about 1 to about 20 carbon atoms and wherein the reaction product is made at a temperature ranging from about 155° to about 200° C. at atmospheric pressure and contains at least one amino triazole group;

(2) a hydrocarbyl succinimide dispersant;

(3) a $C_2$ to $C_{10}$ alkyl alcohol; and (4) a lubricity additive consisting essentially of one or more fatty acids having from about 12 to about 24 carbon atoms in a weight ratio of component (2) to component (4) in the fuel ranging from about 0.5:1 to about 1.5:1;

wherein the hydrocarbyl group of component (1) and (2) is derived from a 500 to 1300 number average molecular weight polyisobutenyl group and wherein a weight ratio of component (1) to component (2) in the fuel ranges from about 1:3 to about 1:5.

2. The fuel of claim 1, further comprising a demulsifier.

3. The fuel of claim 1, wherein the reaction product of component (1) comprises a compound of a formula

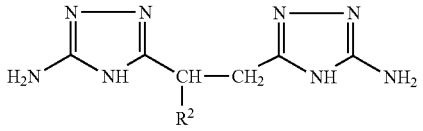

and tautomers thereof wherein $R^2$ is a polyisobutenyl group having a number average molecular weight ranging from about 700 to about 1000.

4. The fuel of claim 1, wherein component (2) is derived from a polyisobutylene substituted succinic anhydride and tetraethylene pentamine.

5. The fuel of claim 4, wherein component (2) comprises a compound of the formula:

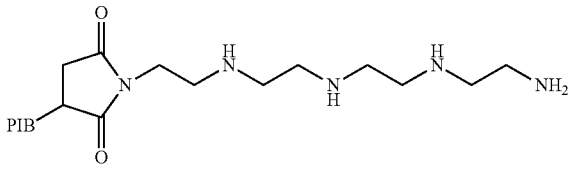

wherein PIB is a polyisobutene radical.

6. The fuel of claim 5, wherein the polyisobutene radical is derived from high reactivity polyisobutenes having at least 60 mole % or more terminal olefinic double bonds.

7. The fuel of claim 4, wherein the fuel comprises a diesel fuel for direct fuel injection.

8. The fuel of claim 1, wherein a molar ratio of (a) to (b) is from about 1:1.5 to about 1:2.2.

9. The fuel of claim 1, wherein the $C_2$ to $C_{10}$ alcohol comprises 2-ethylhexanol.

10. The fuel of claim 1, wherein the amine comprises aminoguanidine bicarbonate.

11. A method of keeping fuel injectors in a diesel engine clean, comprising combusting in the engine the fuel composition of claim 1.

12. A method of improving fuel economy of a diesel engine comprising combusting in the engine a fuel composition comprising a major amount of fuel and from 400 mg to 1000 mg per Kg of fuel of a fuel additive composition comprising:

(1) a reaction product derived from (a) an amine compound or salt thereof of the formula

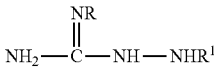

wherein R is selected from the group consisting of hydrogen and a hydrocarbyl group containing from about 1 to about 15 carbon atoms, and $R^1$ is selected from the group consisting of hydrogen and a hydrocarbyl group containing from about 1 to about 20 carbon atoms and (b) a hydrocarbyl carbonyl compound of the formula

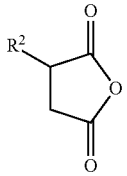

wherein $R^2$ is a polyisobutenyl group having a number average molecular weight ranging from about 500 to about 1300, wherein the reaction product is made at a temperature ranging from about 155° to about 200° C. at atmospheric pressure and the reaction product contains at least one amino triazole group;

(2) a hydrocarbyl succinimide dispersant derived from a hydrocarbyl group having a number average molecular weight ranging from about 500 to less than about 1300 Daltons and a succinic anhydride;

(3) $C_2$ to $C_{10}$ alkyl alcohol;

(4) a demulsifier; and (5) a lubricity additive in a weight ratio of component (2) to component (5) in the fuel ranging from about 0.5:1 to about 1.5:1, wherein a weight ratio of component (1) to component (2) in the fuel ranges from about 1:3 to about 1:5, whereby the fuel economy of the engine is improved relative to the fuel economy of the engine in the absence of the fuel additive composition.

13. The method of claim 12, wherein a weight ratio of component (2) to component (5) in the fuel ranges from about 0.5:1 to about 1.5:1.

14. The method of claim 12, wherein the diesel engine comprises a direct fuel injected diesel engine.

15. The method of claim 12, wherein a molar ratio of (a) to (b) is from about 1.5:1 to about 2.2:1.

16. A method of cleaning fuel injectors of a fuel injected diesel engine comprising combusting in the engine a fuel composition comprising a major amount of fuel and from 400 mg to 1000 mg per Kg of fuel of fuel additive composition comprising:

(1) a reaction product derived from (a) an amine compound or salt thereof of the formula

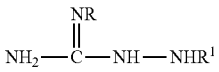

wherein R is selected from the group consisting of hydrogen and a hydrocarbyl group containing from about 1 to about 15 carbon atoms, and $R^1$ is selected from the group consisting of hydrogen and a hydrocarbyl group containing from about 1 to about 20 carbon atoms and (b) a hydrocarbyl carbonyl compound of the formula

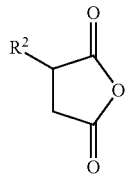

wherein $R^2$ is derived from a polyisobutenyl group having a number average molecular weight ranging from about 700 to about 1000 and greater than about 60 molar % terminal double bonds, wherein the reaction product is made at a temperature ranging from about 155° to about 200° C. at atmospheric pressure and the reaction product contains at least one amino triazole group;

(2) a hydrocarbyl succinimide dispersant derived from a hydrocarbyl group having a number average molecular weight ranging from about 700 to less than about 1000 Daltons and a succinic anhydride;

(3) a lubricity additive in a weight ratio of component (2) to component (3) in the fuel ranging from about 0.5:1 to about 1.5:1; and (4) a demulsifier, wherein a weight ratio of component (1) to component (2) in the fuel ranges from about 1:3 to about 1:5, whereby the injectors are cleaner in the engine combusting the fuel containing the additive composition than injectors in an engine combusting the fuel in the absence of the additive.

17. The method of claim 16, wherein a weight ratio of component (2) to component (3) in the fuel ranging from about 0.5:1 to about 1.5:1.

18. The method of claim 16, further comprising a $C_2$ to $C_{10}$ alkyl alcohol.

19. The method of claim 16, wherein component (2) comprises a compound of the formula:

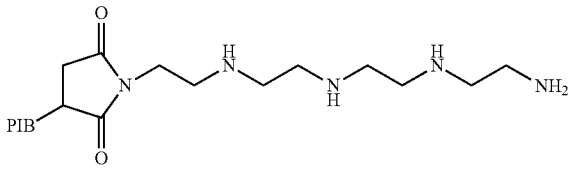

wherein PIB is a polyisobutene radical and the polyisobutene radical is derived from high reactivity polyisobutenes having at least 60 mole % or more terminal olefinic double bonds.

20. A fuel additive package for addition to a diesel fuel distribution terminal for improving the injector cleanliness of a diesel engine combusting the fuel comprising:

(1) a reaction product derived from (a) an amine compound or salt thereof of the formula

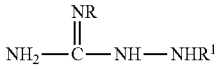

wherein R is selected from the group consisting of hydrogen and a hydrocarbyl group containing from about 1 to about 15 carbon atoms, and $R^1$ is selected from the group consisting of hydrogen and a hydrocarbyl group containing from about 1 to about 20 carbon atoms and (b) a hydrocarbyl carbonyl compound of the formula

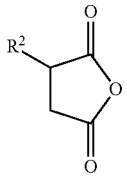

wherein $R^2$ is a polyisobutenyl group having a number average molecular weight ranging from about 700 to about 1000, wherein the reaction product is made at a temperature ranging from about 155° to about 200° C. at atmospheric pressure and the reaction product contains at least one amino triazole group;

(2) a polyisobutene succinimide dispersant derived from polyisobutene having a number average molecular weight ranging from about 700 to less than about 1000 Daltons and a succinic anhydride and greater than about 60 mole % terminal double bonds;

(3) a $C_2$ to $C_{10}$ alkyl alcohol;

(4) a lubricity additive, wherein the lubricity additive consists essentially of one or more fatty acids having from about 12 to about 24 carbon atoms in a weight ratio of component (2) to component (4) in the fuel ranging from about 0.5:1 to about 1.5:1; and (5) a demulsifier, wherein a weight ratio of component (1) to component (2) in the fuel additive package ranges from about 1:3 to about 1:5 and a fuel containing the additive package has from about 400 to about 1000 mg of additive package per Kg of fuel.

21. A method for improving the conductivity of a middle distillate fuel at a fuel distribution terminal where bulk fuel is stored from a pipeline distribution system, comprising adding to the fuel from about 400 to about 1000 mg of a fuel additive package per Kg of fuel whereby the conductivity of the fuel containing the additive package is greater than about 25 picosiemens $m^{-1}$ (pS/m) in the substantial absences of high sulfur-containing conductivity improvers, and wherein the additive package comprises:

(1) a reaction product derived from (a) an amine compound or salt thereof of the formula

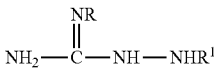

wherein R is selected from the group consisting of hydrogen and a hydrocarbyl group containing from about 1 to about 15 carbon atoms, and $R^1$ is selected from the group consisting of hydrogen and a hydrocarbyl group containing from about 1 to about 20 carbon atoms and (b) a hydrocarbyl carbonyl compound of the formula

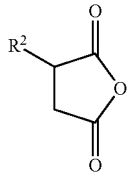

wherein $R^2$ is a polyisobutenyl group having a number average molecular weight ranging from about 700 to about 1000, wherein the reaction product is made at a temperature ranging from about 155° to about 200° C. at atmospheric pressure and the reaction product contains at least one amino triazole group;

(2) a polyisobutene succinimide dispersant derived from polyisobutene having a number average molecular weight ranging from about 700 to less than about 1000 Daltons and a succinic anhydride and greater than about 60 mole % terminal double bonds;

(3) a $C_2$ to $C_{10}$ alkyl alcohol;

(4) a lubricity additive in a weight ratio of component (2) to component (4) in the fuel ranging from about 0.5:1 to about 1.5:1; and (5) a demulsifier, wherein a weight ratio of component (1) to component (2) in the fuel additive package ranges from about 1:3 to about 1:5.

22. A diesel fuel terminal comprising diesel fuel distributed from a pipeline distribution system and from about 400 to about 1000 mg of a fuel additive package per Kg of fuel to lower corrosion potential in the fuel terminal, wherein the additive package comprises:

(1) a reaction product derived from (a) an amine compound or salt thereof of the formula

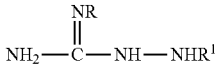

wherein R is selected from the group consisting of hydrogen and a hydrocarbyl group containing from about 1 to about 15 carbon atoms, and $R^1$ is selected from the group consisting of hydrogen and a hydrocarbyl group containing from about 1 to about 20 carbon atoms and (b) a hydrocarbyl carbonyl compound of the formula

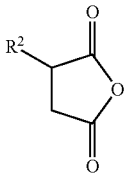

wherein $R^2$ is a polyisobutenyl group having a number average molecular weight ranging from about 700 to about 1000, wherein the reaction product is made at a temperature ranging from about 155° to about 200° C. at atmospheric pressure and the reaction product contains at least one amino triazole group;

(2) a polyisobutene succinimide dispersant derived from polyisobutene having a number average molecular weight ranging from about 700 to less than about 1000 Daltons and a succinic anhydride and greater than about 60 mole % terminal double bonds;

(3) a $C_2$ to $C_{10}$ alkyl alcohol;

(4) a lubricity additive in a weight ratio of component (2) to component (4) in the fuel ranging from about 0.5:1 to about 1.5:1; and (5) a demulsifier, wherein a weight ratio of component (1) to component (2) in the fuel additive package ranges from about 1:3 to about 1:5.

* * * * *